US011357334B2

(12) United States Patent
Choi

(10) Patent No.: US 11,357,334 B2
(45) Date of Patent: Jun. 14, 2022

(54) ADJUSTABLE SUPPORT FOR FOLDABLE BED FRAME AND FOLDABLE BED FRAME HAVING SAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 348 days.

(21) Appl. No.: 15/400,861

(22) Filed: Jan. 6, 2017

(65) Prior Publication Data

US 2017/0196364 A1 Jul. 13, 2017

(30) Foreign Application Priority Data

Jan. 8, 2016 (CN) ..... 201620014822.X

(51) Int. Cl.
*A47C 19/12* (2006.01)
*A47C 19/02* (2006.01)

(52) U.S. Cl.
CPC ..... *A47C 19/12* (2013.01); *A47C 19/024* (2013.01); *A47C 19/025* (2013.01); *A47C 19/122* (2013.01)

(58) Field of Classification Search
CPC ..... A47C 19/12; A47C 19/024; A47C 19/025; A47C 19/122; A47C 19/126; A47C 19/128; A47C 17/64; A47C 17/70; A47C 17/68; A47C 17/76; A47B 19/303
See application file for complete search history.

(56) References Cited

U.S. PATENT DOCUMENTS

| | | | | |
|---|---|---|---|---|
| 202,685 | A | 4/1878 | White | |
| 324,843 | A | 8/1885 | Horton | |
| 337,415 | A | 3/1886 | McKeough | |
| 893,364 | A | 7/1908 | Piaser | |
| 1,196,253 | A | 8/1916 | Lovvy | |
| 1,599,971 | A | 9/1926 | Melson | |
| 3,027,209 | A | 3/1962 | Nielsen | |
| 4,597,553 | A | 7/1986 | Rorabaugh | |
| 4,773,108 | A | 9/1988 | Leever | |
| 6,062,589 | A * | 5/2000 | Cheng | B62B 7/08 280/47.38 |

(Continued)

FOREIGN PATENT DOCUMENTS

| | | |
|---|---|---|
| CN | 201767333 U | 3/2011 |
| CN | 204336376 U | 5/2015 |

(Continued)

OTHER PUBLICATIONS

U.S. Appl. No. 15/144,597, filed May 2, 2016.

(Continued)

*Primary Examiner* — David R Hare
*Assistant Examiner* — Alexis Felix Lopez
(74) *Attorney, Agent, or Firm* — Morgan, Lewis & Bockius LLP

(57) ABSTRACT

Disclosed are adjustable supports and foldable bed frames. An adjustable support includes inner and outer tubular bars movably coupled to each other. A locking mechanism is disposed in the inner tubular bar and includes a positioning piece to restrict the inner and outer tubular bars from moving with respect to each other. An unlocking mechanism is fixedly coupled to the outer tubular bar and includes a push button to unlock the locking mechanism.

13 Claims, 6 Drawing Sheets

(56) References Cited

U.S. PATENT DOCUMENTS

| | | | | |
|---|---|---|---|---|
| 6,223,628 | B1 * | 5/2001 | Barron | H01K 3/32 294/106 |
| 6,575,656 | B2 * | 6/2003 | Suh | E04H 15/46 135/114 |
| 6,938,927 | B1 * | 9/2005 | Martin | A45B 7/00 135/69 |
| 7,066,676 | B2 * | 6/2006 | Tsai | E04H 15/50 135/142 |
| 7,144,078 | B2 * | 12/2006 | Hsieh | A47C 4/48 297/16.1 |
| 7,849,867 | B2 | 12/2010 | Takayama | |
| 7,874,303 | B2 | 1/2011 | Xie | |
| 8,806,677 | B1 * | 8/2014 | Bartelsmeyer | A47C 19/005 5/200.1 |
| 8,856,984 | B1 | 10/2014 | Donham | |
| 8,888,123 | B1 * | 11/2014 | Cheng | B62B 7/066 280/643 |
| 9,027,952 | B2 * | 5/2015 | Zhu | B62B 7/142 280/642 |
| 9,107,509 | B2 | 8/2015 | Lee | |
| 9,248,072 | B2 | 2/2016 | Wu | |
| 9,254,046 | B1 | 2/2016 | Arenstein | |
| 9,456,698 | B2 * | 10/2016 | Oh | A47C 19/12 |
| 9,532,645 | B1 | 1/2017 | Lin | |
| 9,895,003 | B2 | 2/2018 | Choi | |
| 10,123,629 | B2 | 11/2018 | Choi | |
| 10,125,801 | B2 * | 11/2018 | Wilson | F16B 2/245 |
| 10,285,506 | B2 | 5/2019 | Choi | |
| 2003/0009848 | A1 | 1/2003 | Kuo | |
| 2005/0274304 | A1 | 12/2005 | Strong | |
| 2006/0062632 | A1 | 3/2006 | Jang | |
| 2007/0012346 | A1 * | 1/2007 | Choi | E04H 15/60 135/114 |
| 2009/0255564 | A1 | 10/2009 | Xie | |
| 2011/0099712 | A1 | 5/2011 | Jin | |
| 2012/0107037 | A1 | 5/2012 | Huang | |
| 2012/0141195 | A1 | 6/2012 | Lu | |
| 2012/0222216 | A1 | 9/2012 | Jin | |
| 2013/0067659 | A1 | 3/2013 | Oh | |
| 2013/0276228 | A1 | 10/2013 | Hsieh | |
| 2015/0130250 | A1 | 5/2015 | Masunaga | |
| 2015/0320225 | A1 | 11/2015 | Boyd | |
| 2015/0327684 | A1 * | 11/2015 | Lee | A47C 19/025 5/200.1 |
| 2016/0157620 | A1 | 6/2016 | Oh | |
| 2016/0348395 | A1 | 12/2016 | Jin | |
| 2018/0110339 | A1 | 4/2018 | Moon | |
| 2018/0192768 | A1 | 7/2018 | Choi | |
| 2018/0192778 | A1 | 7/2018 | Choi | |
| 2018/0271296 | A1 | 9/2018 | Harrow | |
| 2018/0332973 | A1 | 11/2018 | Choi | |
| 2019/0029435 | A1 | 1/2019 | Choi | |
| 2019/0045938 | A1 | 2/2019 | Skaggs | |
| 2019/0200753 | A1 | 7/2019 | Choi | |

FOREIGN PATENT DOCUMENTS

| | | | | |
|---|---|---|---|---|
| CN | 204336377 U | | 5/2015 | |
| CN | 209185860 U | | 8/2019 | |
| GB | 810195 A | * | 3/1959 | A45B 19/04 |

OTHER PUBLICATIONS

U.S. Appl. No. 15/389,298, filed Dec. 22, 2016.
U.S. Appl. No. 15/600,581, filed May 19, 2017.
U.S. Appl. No. 15/423,055, filed Feb. 2, 2017.
U.S. Appl. No. 15/423,161, filed Feb. 2, 2017.
U.S. Appl. No. 15/807,448, filed Nov. 8, 2017.
U.S. Appl. No. 15/946,542, filed Apr. 5, 2018.

* cited by examiner

ADJUSTABLE SUPPORT FOR FOLDABLE BED FRAME AND FOLDABLE BED FRAME HAVING SAME

CROSS-REFERENCE TO RELATED APPLICATIONS

The present application claims priority to Chinese Utility Model Application CN 201620014822.X filed Jan. 8, 2016. The disclosure of the application is incorporated herein for all purposes by reference in its entirety.

FIELD OF THE INVENTION

The present invention generally relates to supports and bed frames having such supports. More particularly, the present invention relates to adjustable supports and foldable bed frames having such adjustable supports.

BACKGROUND

Generally, a foldable bed frame includes two pivotally connected sub-frames, and legs pivotally connected to and supporting the sub-frames. To stabilize the foldable bed frame, legs are usually connected to each other by lateral bars, and lateral bars are connected to sub-frames by supports. One example of such a foldable bed frame is disclosed in CN 204336377 U, the disclosure of which is incorporated herein for all purposes by reference. Another example is disclosed in CN 204336376 U, the entire disclosure of which is incorporated herein for all purposes by reference.

Supports in a typical existing foldable bed frame are generally coupled to the lateral bars and the sub-frames without releasing or unlocking mechanisms. Decoupling such supports is accomplished by pushing the supports sideways. In some cases, supports are short bars or struts directly fastened to the lateral bars and the sub-frames. Such supports exert forces on fasteners. Gradually, the fasteners become loose, resulting in an unstable bed frame.

Given the current state of the art, there remains a need for supports and foldable bed frames that address the above-mentioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present invention provides adjustable supports and foldable bed frames that are stable and safe to use.

In various embodiments, the present invention provides an adjustable support including an inner tubular bar, an outer tubular bar, a locking mechanism and an unlocking mechanism. The inner tubular bar has a first restriction hole formed on a side wall of the inner tubular bar. The outer tubular bar is movably coupled to the inner tubular bar. The outer tubular bar has a second restriction hole formed on a side wall of the outer tubular bar and corresponding to the first restriction hole of the inner tubular bar. The locking mechanism is disposed in the inner tubular bar. The locking mechanism includes a positioning piece configured to be protruded outwardly and into the first restriction hole of the inner tubular bar and the second restriction hole of the outer tubular bar, thereby restricting the inner and outer tubular bars from moving with respect to each other. The unlocking mechanism includes a sleeve fitting configured to be fixedly coupled to a proximal end of the outer tubular bar, and a push button elastically coupled to or formed with the sleeve fitting. The push button is configured to release the positioning piece from one or more of the first and second restriction holes, thereby allowing the inner and outer tubular bars to move with respect to each other.

In an exemplary embodiment, the locking mechanism includes an elastic member disposed inside of the inner tubular bar. The positioning piece is coupled to, or formed with, the elastic member and adjacent to an end of the elastic member. The elastic member is configured to push the positioning piece outwardly and into the first and second restriction holes.

In an exemplary embodiment, the second restriction hole of the outer tubular bar is formed at a proximal end of the outer tubular bar with respect to the inner tubular bar.

In some embodiments, the sleeve fitting is snap-fitted onto the proximal end of the outer tubular bar. In various embodiments, the outer tubular bar includes one or more notches formed at the proximal end of the outer tubular bar and the sleeve fitting includes one or more snap joints. A respective snap joint in the one or more joints mates with a corresponding notch in the one or more notches, thereby fixedly coupling the sleeve fitting with the proximal end of the outer tubular bar. In an exemplary embodiment, the outer tubular bar includes two notches formed at opposite walls of the proximal end of the outer tubular bar, and the sleeve fitting includes two snap joints formed at opposite walls of the sleeve fitting. In an exemplary embodiment, the sleeve fitting includes a guide tilted outwardly.

In some embodiments, the push button includes a cover plate and a protrusion. The cover plate is larger than the positioning piece of the locking mechanism to facilitate easy exertion of a pushing force. The protrusion is protruded from the cover plate and configured to be insertable into the second restriction hole of the outer tubular bar or into both of the first restriction hole of the inner tubular bar and the second restriction hole of the outer tubular bar. Thus, by pushing the cover plate, the protrusion pushes the positioning piece inwardly and releases the positioning piece from the second restriction hole of the outer tubular bar or from both of the first restriction hole of the inner tubular bar and the second restriction hole of the outer tubular bar, thereby allowing the inner and outer tubular bars to move with respect to each other. In an embodiment, the protrusion of the unlocking mechanism includes a recess to engage with the positioning piece of the locking mechanism.

In some embodiments, the present invention provides an adjustable support including an inner tubular bar, an outer tubular bar, a locking mechanism and an unlocking mechanism. The inner tubular bar has a first restriction hole formed on a side wall of the inner tubular bar. The outer tubular bar is movably coupled to the inner tubular bar. The outer tubular bar has a second restriction hole formed on a side wall of the outer tubular bar and corresponding to the first restriction hole of the inner tubular bar. The locking mechanism is disposed in the inner tubular bar. The unlocking mechanism is disposed at the outer tubular bar and includes a cover plate and a protrusion. The cover plate is larger than the positioning piece of the locking mechanism to facilitate easy exertion of a pushing force. The protrusion is protruded from the cover plate and configured to be insertable into the second restriction hole of the outer tubular bar or into both of the first restriction hole of the inner tubular bar and the second restriction hole of the outer tubular bar. Thus, by pushing the cover plate, the protrusion pushes the positioning piece inwardly and releases the positioning piece from the second restriction hole of the outer tubular bar or from both of the first restriction hole of the inner tubular bar and the second restriction hole of the outer tubular bar, thereby allowing the inner and outer tubular bars to move with respect to each other. In an embodiment, the unlocking mechanism further includes a sleeve fitting configured to be fixedly coupled to a proximal end of the outer tubular bar. The cover plate is elastically coupled to, or formed with, the sleeve fitting.

In some embodiments, the present invention provides a foldable bed frame including first and second sub-frames pivotally connected to each other at their proximal sides. Corresponding to each of the first and second sub-frames, the foldable bed frame further includes a leg assembly pivotally connected to the sub-frame, and one or more adjustable supports disclosed herein. Each adjustable support has one end connected to the sub-frame and the other end connected to the leg assembly. When locked, the one or more adjustable supports restrict the leg assembly from rotating toward or away from the sub-frame. When unlocked, the one or more adjustable supports allow the leg assembly to fold or unfold with respect to the sub-frame.

In an exemplary embodiment, the leg assembly is disposed at a distal side of the first or second sub-frame. In an exemplary embodiment, the foldable bed frame further includes a middle leg assembly disposed between the first and second sub-frames, and pivotally connected to both of the first and second sub-frames at their proximal sides. In various embodiments, the ends of one or each adjustable support in the one or more adjustable supports are connected to lateral bars of the leg assembly and the sub-frame.

The adjustable supports and foldable bed frames of the present invention have other features and advantages that will be apparent from, or are set forth in more detail in, the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present invention and, together with the Detailed Description, serve to explain the principles and implementations of exemplary embodiments of the invention.

DETAILED DESCRIPTION

Figure 1:
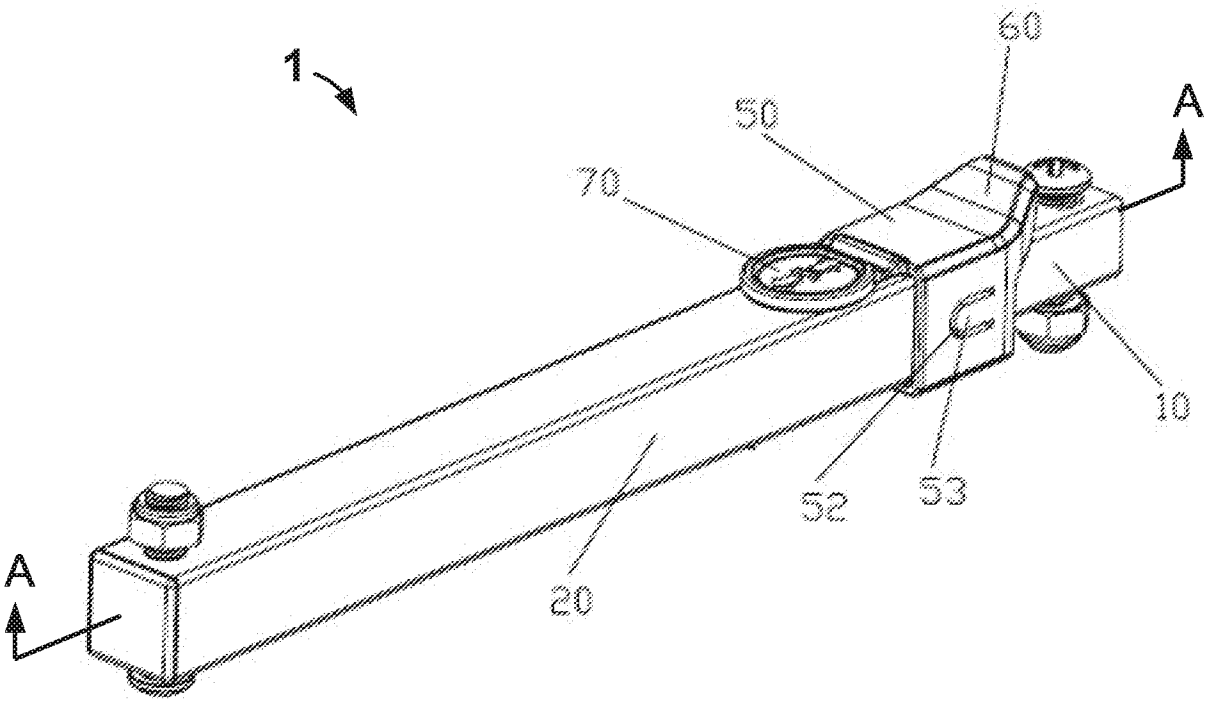
FIG. 1 is a perspective view illustrating an adjustable support in accordance with exemplary embodiments of the present invention.

Reference will now be made in detail to implementations of exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the embodiments, as will be apparent to those skilled in the art. The specific exemplary embodiments described herein are offered by way of example only.

Exemplary embodiments of the present invention are described in the context of supports and foldable bed frames. The bed frames are of various sizes including, but not limited to, twin, full, queen and king sizes, and of various shapes including but not limited to rectangles and squares. Also, the bed frames can be made of various materials including, but not limited to, metals such as steel, plastics and woods.

Generally, an adjustable support of the present invention includes an inner tubular bar, an outer tubular bar, a locking mechanism and an unlocking mechanism. The inner and outer tubular bars are movably coupled to each other. An exemplary locking mechanism is configured to restrict the inner and outer tubular bars from moving with respect to each other, and an exemplary unlocking mechanism is configured to release the restriction. Exemplary supports of the present invention can be used in a foldable bed frame, for instance, between a sub-frame and a leg assembly pivotally connected to the sub-frame. When locked, the support restricts the leg assembly from rotating with respect to the sub-frame, and thus enhances the stability of the bed frame. When the restriction is released, the support allows the leg assembly to fold and unfold with respect to the sub-frame.

Referring to FIGS. 1-5, there is depicted exemplary adjustable support 1 in accordance with various embodiments of the present invention. As shown, adjustable support 1 includes inner tubular bar 10, outer tubular bar 20, locking mechanism 80 and unlocking mechanism 90. The inner and outer tubular bars are movably coupled to each other, with a portion (e.g., a proximal end) of the inner tubular bar being inserted into the outer tubular bar. The inner tubular bar has at least one restriction hole such as first restriction hole 14 formed on a side wall of the inner tubular bar. The outer tubular bar has at least one restriction hole such as second restriction hole 24 formed on a side wall of the outer tubular bar. The first restriction hole of the inner tubular bar and the second restriction hole of the second tubular bar are corresponding to each other (e.g., they can be aligned to each other). In an embodiment, the second restriction hole of the outer tubular bar is formed at a proximal end of the outer tubular bar with respect to the inner tubular bar (e.g., the end of the outer tubular bar on the right-hand side in FIG. 1).

As used herein, the term "tubular bar" refers to an elongated bar that is hollow along a portion or an entire length of the bar. The cross section of the tubular bar can be of any suitable shape, e.g., regular or irregular, including, but not limited to, circular and polygonal.

Locking mechanism 80 is configured to restrict the movement of the inner and outer tubular bars with respect to each other. In some embodiments, locking mechanism 80 is disposed in the inner tubular bar, and includes a positioning piece such as positioning piece 40. When the first and second restriction holes are aligned with each other, positioning piece 40 is protruded outwardly and into the first restriction hole of the inner tubular bar and the second restriction hole of the outer tubular bar. As a result, the inner and outer tubular bars are restricted from moving with respect to each other.

Figure 5:
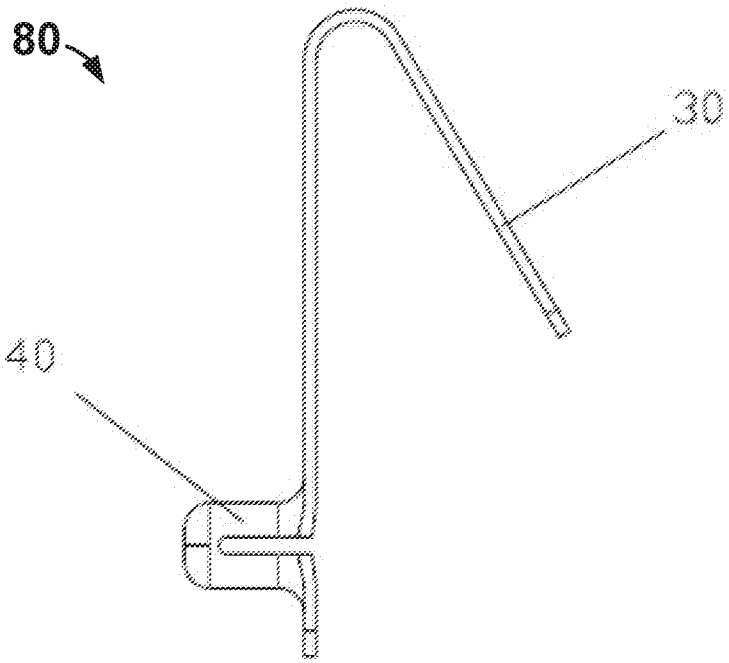
FIG. 5 is a side view illustrating a locking mechanism in accordance with exemplary embodiments of the present invention.

In some embodiments, locking mechanism 80 includes an elastic member such as elastic member 30 illustrated in FIG. 5. In an exemplary embodiment, the elastic member has a substantially "V" shape, and positioning piece 40 is coupled to or formed with the elastic member and adjacent to an end of the elastic member. The elastic member pushes the positioning piece outwardly; and when the first and second restriction holes are aligned with each other, the elastic member pushes the position piece into the first and second restriction holes of the inner and outer tubular bars.

Unlocking mechanism 90 is configured to unlock the locking mechanism and thus allow the inner and outer tubular bars to move with respect to each other. In some embodiments, unlocking mechanism 90 includes a fitting such as sleeve fitting 50 and a push interface such as push button 70.

Figure 2:
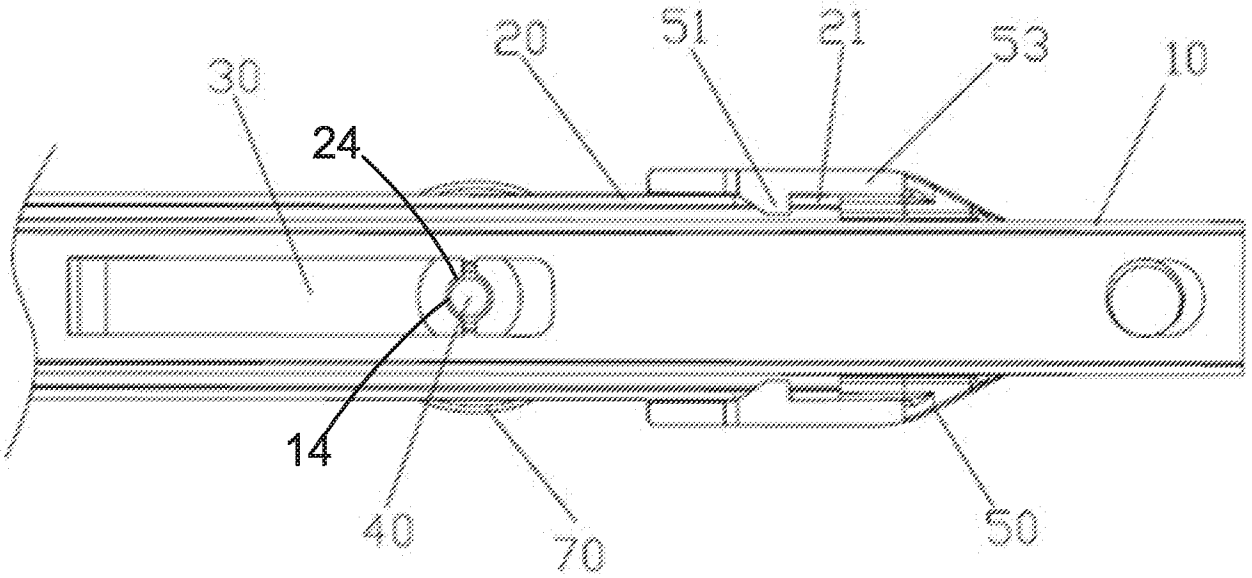
FIG. 2 is a cutout partial view of FIG. 1 along line A-A.
Figure 3:
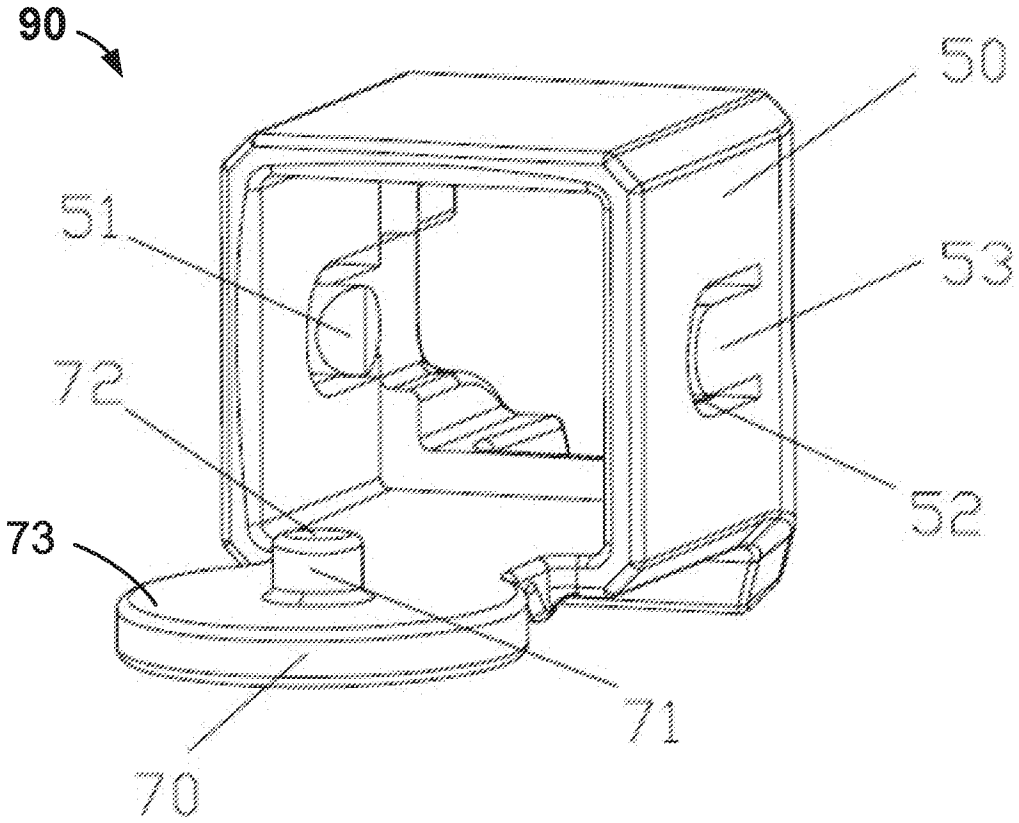
FIG. 3 is a perspective view illustrating an unlocking mechanism in accordance with exemplary embodiments of the present invention.
Figure 4:
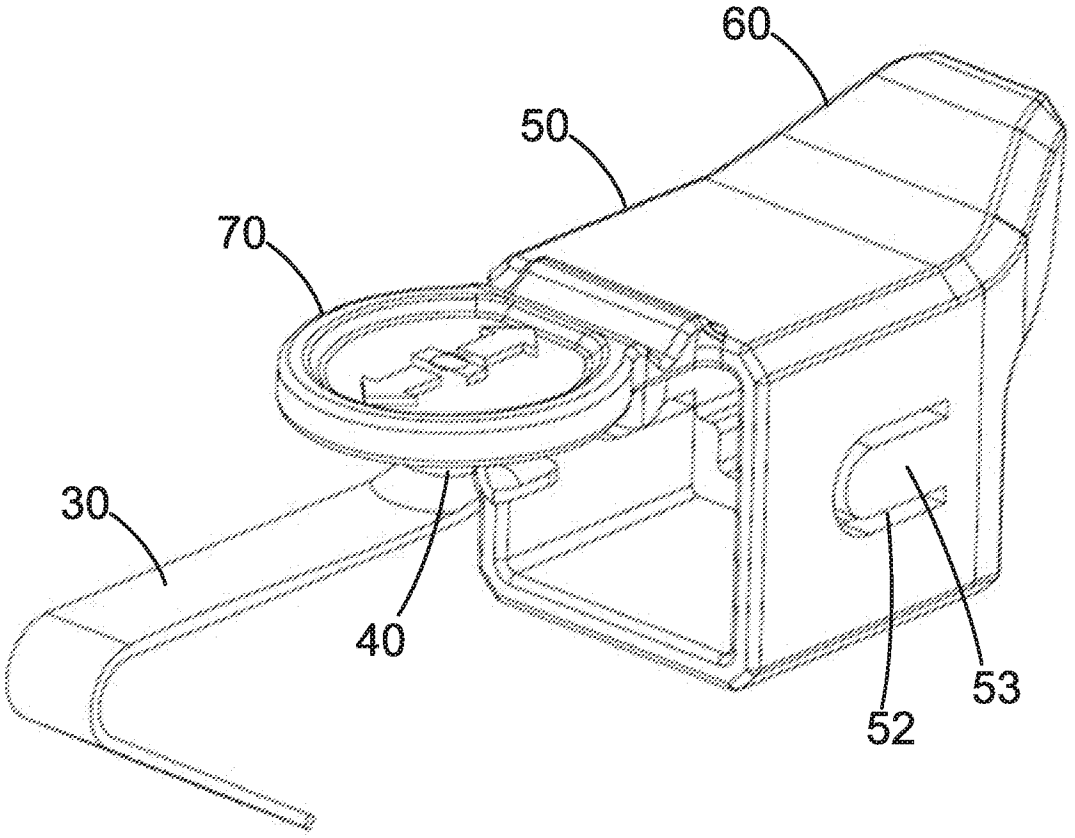
FIG. 4 is a perspective view illustrating locking and unlocking mechanisms in accordance with exemplary embodiments of the present invention.

Sleeve fitting 50 is configured to be fixedly coupled to the proximal end of the outer tubular bar. In some embodiments, the sleeve fitting is snap-fitted onto the proximal end of the outer tubular bar. For instance, in some embodiments, the outer tubular bar includes one or more notches such as notches 21 formed at the proximal end of the outer tubular bar. Sleeve fitting 50 includes one or more snap joints, each including elastic piece 53 and protrusion 51 protruded inwardly from elastic piece 53. Protrusions 51 of the snap joints mate with corresponding notches 21, and thus fixedly coupling the sleeve fitting onto the proximal end of the outer tubular bar. By way of example, FIGS. 2 and 3 illustrate two notches formed at opposite walls of the proximal end of the outer tubular bar and two snap joints formed at opposite walls of the sleeve fitting. In an embodiment, elastic piece 53 is formed integrally with the main body of the sleeve fitting with a cut or a gap (e.g., gap 52) between the elastic piece and the main body of the sleeve fitting.

Push button 70 is configured to release the positioning piece from the second restriction hole of the outer tubular bar, or from both of the first restriction hole of the inner tubular bar and the second restriction hole of the outer tubular bar. As a result, the inner and outer tubular bars are allowed to move with respect to each other. In some embodiments, push button 70 includes cover plate 73 elastically coupled to, or formed with, the sleeve fitting. Push button 70 also includes protrusion 71 protruded from the cover plate. Protrusion 71 is configured to be insertable into the second restriction hole of the outer tubular bar or into both of the first restriction hole of the inner tubular bar and the second restriction hole of the outer tubular bar. In an embodiment, protrusion 71 of the unlocking mechanism includes recess 72 to engage with positioning piece 40 of the locking mechanism. Thus, by pushing the cover plate, the protrusion pushes the positioning piece inwardly and releases the positioning piece from the second restriction hole of the outer tubular bar or from both of the first restriction hole of the inner tubular bar and the second restriction hole of the outer tubular bar. As a result, the restriction is released, and the inner and outer tubular bars are allowed to move with respect to each other.

In some embodiments, cover plate 73 is configured to be larger than positioning piece 40 of the locking mechanism (e.g., having at least one dimension larger than that of the positioning piece. For instance, in an embodiment where the cover plate and the positional piece are of circular shapes, the cover plate has a diameter that is larger than the diameter of the positioning piece. Cover plate 73 facilitates easy exertion of a pushing force. With the cover plate, a user can release the restriction and thus fold/unfold leg assemblies easily and quickly.

In some embodiments, sleeve fitting 50 includes guide 60 tilted outwardly to facilitate easy insertion of the inner tubular bar into the outer tubular bar.

Figure 6:
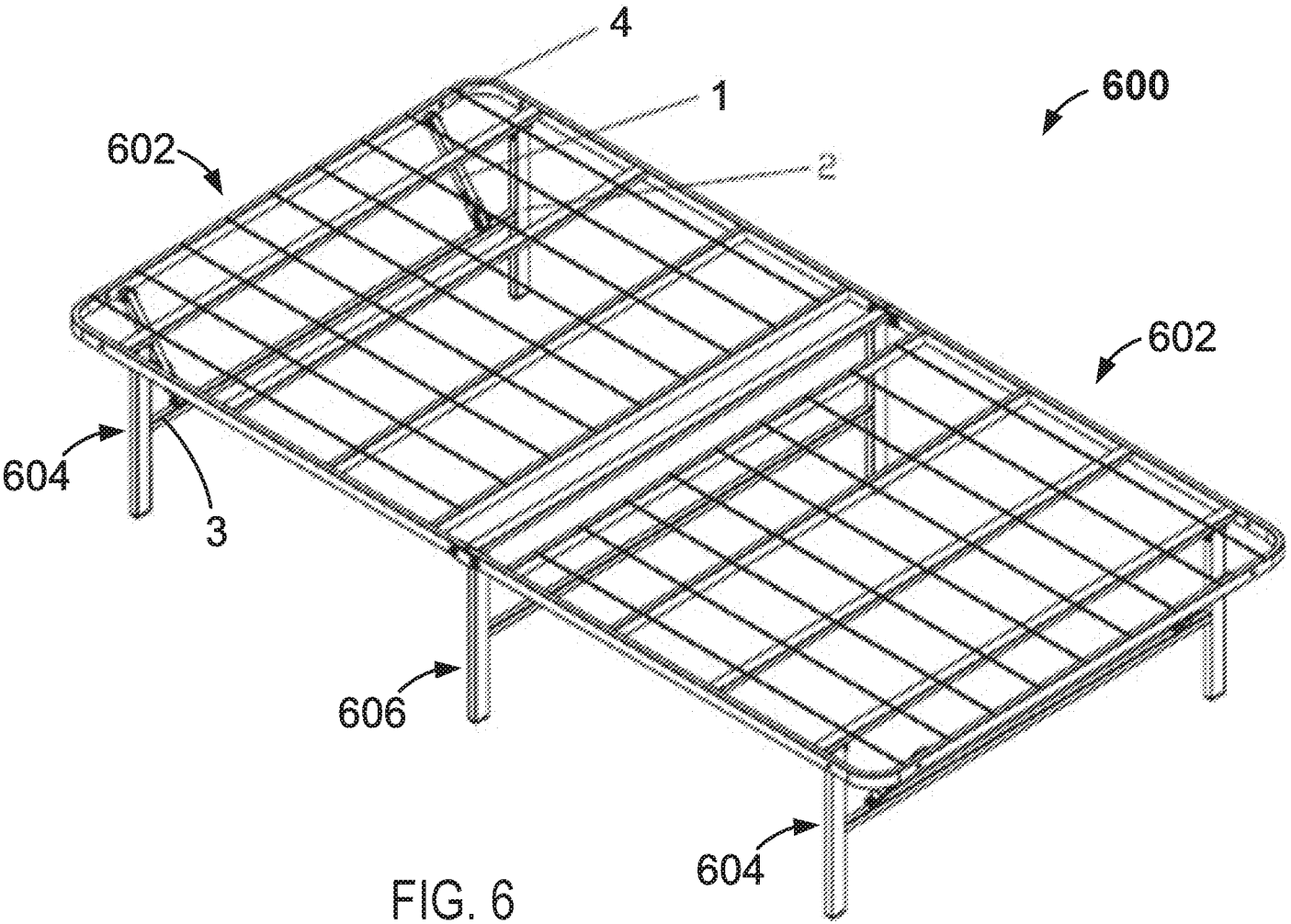
FIG. 6 is a perspective view illustrating a foldable bed frame in an unfolded state in accordance with exemplary embodiments of the present invention.

Referring now to FIG. 6, there is depicted an exemplary foldable bed frame 600 in accordance with various embodiments of the present invention. An exemplary foldable bed frame of the present invention generally includes a plurality of sub-frames such as first and second sub-frames 602 pivotally connected to each other at their proximal sides. As used herein, the sides at which first and second sub-frames 602 are connected to each other are referred to as their proximal sides, and the sides opposite the proximal sides are referred to as their distal sides. For instance, in FIG. 6, the proximal sides of first and second sub-frames are in the middle of the foldable bed frame. The distal sides correspond to head and foot sections of the bed frame. It should be noted that the term "middle" as used herein does not necessarily mean the center of the bed frame, and the term "side" does not necessarily mean an outmost edge of the bed frame.

Corresponding to each sub-frame (e.g., the first or the second sub-frame), the foldable bed frame includes a leg assembly pivotally connected to the sub-frame. The leg assembly can be disposed at a distal side, a proximal side, or any suitable location between the distal and proximal sides of the sub-frame. By way of example, FIG. 6 illustrates first and second leg assemblies 604 pivotally connected to the distal sides of the first and second sub-frames, respectively. In some embodiments, leg assembly 604 includes first and second legs such as leg 2 and a lateral bar such as lateral bar 3 disposed between the first and second legs. In some embodiments, the foldable bed frame further includes one or more supports such as adjustable supports 1 between a sub-frame and a leg assembly. For instance, FIG. 6 illustrates two adjustable supports 1 for each pair of the sub-frame and the leg assembly. Each adjustable support 1 has one end connected to the sub-frame and the other end connected to the leg assembly. In some embodiments, each adjustable support 1 has one end connected to a lateral bar (e.g., lateral bar 4) of the sub-frame, and the other end connected to a lateral bar (e.g., lateral bar 3) of the leg assembly.

In some embodiments, a foldable bed frame includes middle leg assembly 606 disposed between the first and second sub-frames. Middle leg assembly 606 is pivotally connected to both of the first and second sub-frames at their proximal sides.

As disclosed herein, adjustable support 1 includes inner tubular bar 10, outer tubular bar 20, locking mechanism 80 and unlocking mechanism 90. With these features, folding and unfolding the bed frame is simple and convenient. For example, to unfold the bed frame, rotate the leg assembly away from the sub-frame. As one end of the adjustable support is connected to the leg assembly and the other end of the adjustable support is connected to the sub-frame, rotating the leg assembly causes the movement of the inner and outer tubular bars with respect to each other. When the leg assembly is unfolded, the first and second restriction holes of the inner and outer tubular bars are aligned with each other. Aided by the elastic member, the positioning piece of the locking mechanism is protruded outwardly and into the first and second restriction holes of the inner and outer tubular bars, and thus restricts the inner and outer tubular bars from further movements. At this stage, the sub-frame, the leg assembly and the adjustable support(s) collectively form a triangular structure, making the unfolded bed frame firm and stable. To fold the leg assembly or the bed frame, push the push button of the unlocking mechanism to disengage the positioning piece of the locking mechanism from the restriction hole of the outer tubular bar or from the restriction holes of both the inner and outer tubular bars. Disengaging the position piece allows the inner and outer tubular bars to move with respect to each other and thus allows the leg assembly to rotate toward and fold onto the sub-frame.

As the locking and unlocking mechanisms are disposed at the inner and outer tubular bars, potential loss of components is prevented. In addition, as the adjustable support is connected to the sub-frame and the leg assembly, spaces underneath the bed frame are still usable, e.g., for storing household items.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "inward" or "outward", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first sub-frame could be termed a second sub-frame, and, similarly, a second sub-frame could be termed a first sub-frame, without changing the meaning of the description, so long as all occurrences of the "first sub-frame" are renamed consistently and all occurrences of the "second sub-frame" are renamed consistently.

What is claimed is:

1. An adjustable support for a foldable bed frame comprising:

an inner tubular bar having a first restriction hole formed on a side wall of the inner tubular bar;

an outer tubular bar movably coupled to the inner tubular bar, the outer tubular bar having a second restriction hole formed on a side wall of the outer tubular bar and corresponding to the first restriction hole of the inner tubular bar;

a locking mechanism disposed in the inner tubular bar, wherein the locking mechanism comprises a positioning piece configured to be protruded outwardly and into the first restriction hole of the inner tubular bar and the second restriction hole of the outer tubular bar, thereby restricting the inner and outer tubular bars from moving with respect to each other; and an unlocking mechanism comprising:

a sleeve fitting fixedly coupled to a proximal end of the outer tubular bar such that the sleeve fitting maintains at the proximal end of the outer tubular bar while the inner and outer tubular bars move with respect to each other, the sleeve fitting comprising a first edge and a second edge spaced apart from the first edge in a longitudinal direction of the outer tubular bar, and a push button elastically coupled to or formed with the sleeve fitting, wherein the push button is extended from the first edge of the sleeve fitting and away from the second edge of the sleeve fitting in the longitudinal direction of the outer tubular bar such that when coupled to the outer tubular bar, the sleeve fitting and push button are disposed side by side along the longitudinal direction of the outer tubular bar with the push button at a side of the first edge of the sleeve fitting opposite to the second edge of the sleeve fitting, wherein the push button is configured to release the positioning piece from one or more of the first and second restriction holes, thereby allowing the inner and outer tubular bars to move with respect to each other while the sleeve fitting maintains at the proximal end of the outer tubular bar;

wherein the sleeve fitting further comprises a guide extended from the second edge of the sleeve fitting and tilted outwardly to facilitate easy insertion of the inner tubular bar into the outer tubular bar.

2. The adjustable support of claim 1, wherein the locking mechanism comprises:

an elastic member disposed inside of the inner tubular bar, wherein the positioning piece is coupled to or formed with the elastic member and adjacent to an end of the elastic member, and the elastic member is configured to push the positioning piece outwardly and into the first and second restriction holes.

3. The adjustable support of claim 1, wherein the second restriction hole of the outer tubular bar is formed at a proximal end of the outer tubular bar with respect to the inner tubular bar.

4. The adjustable support of claim 1, wherein the sleeve fitting is snap-fitted onto the proximal end of the outer tubular bar.

5. The adjustable support of claim 1, wherein:

the outer tubular bar comprises one or more notches formed at the proximal end of the outer tubular bar; and the sleeve fitting comprises one or more snap joints, wherein a respective snap joint in the one or more joints mates with a corresponding notch in the one or more notches, thereby fixedly coupling the sleeve fitting with the proximal end of the outer tubular bar.

6. The adjustable support of claim 1, wherein:

the outer tubular bar comprises two notches formed at opposite walls of the proximal end of the outer tubular bar; and the sleeve fitting comprises two snap joints formed at opposite walls of the sleeve fitting, wherein each of the two snap joints mates with a corresponding notch in the two notches, thereby fixedly coupling the sleeve fitting with the proximal end of the outer tubular bar.

7. A foldable bed frame comprising:

first and second sub-frames pivotally connected to each other at proximal sides thereof; and corresponding to each of the first and second sub-frames, the foldable bed frame further comprising:

a leg assembly pivotally connected to the sub-frame; and one or more adjustable supports according to claim 1, each having one end connected to the sub-frame and the other end connected to the leg assembly, wherein when locked, the one or more adjustable supports restrict the leg assembly from rotating toward or away from the sub-frame, and when unlocked, the one or more adjustable supports allow the leg assembly to fold or unfold with respect to the sub-frame.

8. The foldable bed frame of claim 7, wherein the leg assembly is disposed at a distal side of the first or second sub-frame.

9. The foldable bed frame of claim 7, further comprising:

a middle leg assembly disposed between the first and second sub-frames, and pivotally connected to both of the first and second sub-frames at the proximal sides thereof.

10. The foldable bed frame of claim 7, wherein:

the ends of one or each adjustable support in the one or more adjustable supports are connected to lateral bars of the leg assembly and the sub-frame.

11. An adjustable support for a foldable bed frame comprising:

an inner tubular bar having a first restriction hole formed on a side wall of the inner tubular bar;

an outer tubular bar movably coupled to the inner tubular bar, the outer tubular bar having a second restriction hole formed on a side wall of the outer tubular bar and corresponding to the first restriction hole of the inner tubular bar;

a locking mechanism disposed in the inner tubular bar, wherein the locking mechanism comprises a positioning piece configured to be protruded outwardly and into the first restriction hole of the inner tubular bar and the second restriction hole of the outer tubular bar, thereby restricting the inner and outer tubular bars from moving with respect to each other; and an unlocking mechanism comprising a sleeve fitting fixedly coupled to a proximal end of the outer tubular bar, and a push button elastically coupled to or formed with the sleeve fitting, wherein the push button is configured to release the positioning piece from one or more of the first and second restriction holes, thereby allowing the inner and outer tubular bars to move with respect to each other while the sleeve fitting maintains at the proximal end of the outer tubular bar, wherein the push button comprises:

a cover plate larger than the positioning piece of the locking mechanism to facilitate exertion of a pushing force; and a protrusion protruded from the cover plate and configured to be insertable into the second restriction hole of the outer tubular bar or into both of the first restriction hole of the inner tubular bar and the second restriction hole of the outer tubular bar, wherein by pushing the cover plate, the protrusion pushes the positioning piece inwardly and releases the positioning piece from the second restriction hole of the outer tubular bar or from both of the first restriction hole of the inner tubular bar and the second restriction hole of the outer tubular bar, thereby allowing the inner and outer tubular bars to move with respect to each other;

wherein the protrusion of the unlocking mechanism comprises a recess, recessing toward the cover plate, to engage with the positioning piece of the locking mechanism; and wherein the sleeve fitting comprises a guide tilted outwardly.

12. A foldable bed frame comprising:

first and second sub-frames pivotally connected to each other at proximal sides thereof; and corresponding to each of the first and second sub-frames, the foldable bed frame further comprising:

a leg assembly pivotally connected to the sub-frame; and one or more adjustable supports according to claim 11, each having one end connected to the sub-frame and the other end connected to the leg assembly, wherein when locked, the one or more adjustable supports restrict the leg assembly from rotating toward or away from the sub-frame, and when unlocked, the one or more adjustable supports allow the leg assembly to fold or unfold with respect to the sub-frame.

13. The foldable bed frame of claim 12, wherein:

the ends of one or each adjustable support in the one or more adjustable supports are connected to lateral bars of the leg assembly and the sub-frame.

* * * * *